US011777217B2

(12) United States Patent
Uchida et al.

(10) Patent No.: US 11,777,217 B2
(45) Date of Patent: Oct. 3, 2023

(54) ANTENNA MEMBER AND ASSEMBLY

(71) Applicant: Japan Aviation Electronics Industry, Limited, Tokyo (JP)

(72) Inventors: Jun Uchida, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 2 days.

(21) Appl. No.: 17/536,231

(22) Filed: Nov. 29, 2021

(65) Prior Publication Data

US 2022/0224010 A1 Jul. 14, 2022

(30) Foreign Application Priority Data

Jan. 14, 2021 (JP) ..... 2021-004233

(51) Int. Cl.

| | |
|---|---|
| ***H01Q 7/00*** | (2006.01) |
| ***H01Q 1/22*** | (2006.01) |
| *H01Q 1/36* | (2006.01) |
| *H01Q 1/38* | (2006.01) |
| *H01Q 1/50* | (2006.01) |
| *H01Q 1/46* | (2006.01) |

(52) U.S. Cl.
CPC ..... *H01Q 7/00* (2013.01); *H01Q 1/2283* (2013.01)

(58) Field of Classification Search
CPC ..... H01Q 7/00; H01Q 1/2283; H01Q 1/36; H01Q 1/50; H01Q 1/46
USPC ..... 346/866; 343/866
See application file for complete search history.

(56) References Cited

U.S. PATENT DOCUMENTS 8,816,921 B2 * 8/2014 Ayatollahi ..... H01Q 1/243 343/702
10,367,248 B2 7/2019 Toyao et al.
(Continued)

FOREIGN PATENT DOCUMENTS

CN 102082323 A 6/2011
CN 103682591 A 3/2014
(Continued)

OTHER PUBLICATIONS

Taiwanese Office Action dated Nov. 7, 2022 in Taiwanese Application No. 110145196 with English translation.
(Continued)

*Primary Examiner* — Dimary S Lopez Cruz
*Assistant Examiner* — Brandon Sean Woods
(74) *Attorney, Agent, or Firm* — Collard & Roe, P.C.

(57) ABSTRACT

An antenna member is configured to be mounted on a circuit board and to be used as an antenna. The antenna member has a split ring resonating portion, an impedance matching portion and a feed portion. The split ring resonating portion is provided with a facing portion which forms a split. The split ring resonating portion has a first side portion, a second side portion and an upper portion. The upper portion connects the first side portion and the second side portion with each other. The feed portion is provided on at least one of the first side portion and the second side portion. The impedance matching portion is positioned above the feed portion in an up-down direction perpendicular to a lateral direction. The impedance matching portion couples the first side portion and the second side portion with each other.

4 Claims, 13 Drawing Sheets

(56) References Cited

U.S. PATENT DOCUMENTS

| | | | | |
|---|---|---|---|---|
| 10,476,143 | B1 * | 11/2019 | Buccinna | H01Q 1/40 |
| 11,101,563 | B2 | 8/2021 | Hashiguchi et al. | |
| 11,223,115 | B2 | 1/2022 | Hashiguchi | |
| 2011/0128125 | A1 | 6/2011 | Kai et al. | |
| 2014/0062801 | A1 | 3/2014 | Yong et al. | |
| 2017/0133765 | A1 * | 5/2017 | Moldovan | H01Q 9/0485 |
| 2020/0220269 | A1 * | 7/2020 | Matsuura | H01Q 9/045 |
| 2020/0335849 | A1 | 10/2020 | Hashiguchi | |
| 2021/0194132 | A1 | 6/2021 | Soma et al. | |

FOREIGN PATENT DOCUMENTS

| | | | |
|---|---|---|---|
| JP | WO2015/151430 | A1 | 4/2017 |
| JP | 6240040 | B2 | 11/2017 |
| JP | 2020-145542 | A | 9/2020 |
| TW | 202034577 | A | 9/2020 |
| TW | 202034578 | A | 9/2020 |
| WO | 2020/054681 | A1 | 3/2020 |

OTHER PUBLICATIONS

Extended European Search Report in EP 21211487.0-1205 dated May 6, 2022.

Gaurav Upadhyay et al: "Dual-feed CSRR-loaded switchable multiband microstrip patch antenna for ITS applications", IET Microwaves, Antennas & PROPAGATION, Sep. 3, 2018, 6 pages, DOI: 10.1049/IET-MAP.2018.5269.

Chinese Office Action dated May 12, 2023 in Chinese Application No. 202111449203.5, with English translation.

* cited by examiner

ANTENNA MEMBER AND ASSEMBLY

CROSS REFERENCE TO RELATED APPLICATIONS

This application is based on and claims priority under 35 U.S.C. § 119 to Japanese Patent Application No. JP2021-004233 filed Jan. 14, 2021, the contents of which are incorporated herein in their entirety by reference.

BACKGROUND OF THE INVENTION

This invention relates to an antenna member which is configured to be mounted on a circuit board.

Referring to FIG. 25, JPB6240040 (Patent Document 1) discloses an antenna member 900 which is configured to be mounted on a circuit board (not shown) and to be used as an antenna. The antenna member 900 has a split ring resonating portion 910, an impedance matching portion 920 and a feed portion 930. The split ring resonating portion 910 is provided with a facing portion 912 which forms a split 911. The split ring resonating portion 910 has a first side portion 914, a second side portion 916 and an upper portion 918. The second side portion 916 is positioned away from the first side portion 914 in a Y-direction. The upper portion 918 connects the first side portion 914 and the second side portion 916 with each other.

There is a requirement for an antenna member, such as the antenna member 900 of Patent Document 1, to be further miniaturized.

SUMMARY OF THE INVENTION

It is therefore an object of the present invention to provide an antenna member which can be further miniaturized.

One aspect of the present invention provides an antenna member which is configured to be mounted on a circuit board and to be used as an antenna. The antenna member has a split ring resonating portion, an impedance matching portion and a feed portion. The split ring resonating portion is provided with a facing portion which forms a split. The split ring resonating portion has a first side portion, a second side portion and an upper portion. The second side portion is positioned away from the first side portion in a lateral direction. The upper portion connects the first side portion and the second side portion with each other. The feed portion is provided on at least one of the first side portion and the second side portion. The impedance matching portion is positioned above the feed portion in an up-down direction perpendicular to the lateral direction. The impedance matching portion couples the first side portion and the second side portion with each other.

The antenna member of the present invention is configured so that the impedance matching portion is positioned above the feed portion in the up-down direction perpendicular to the lateral direction and couples the first side portion and the second side portion with each other. Accordingly, the antenna member of the present invention is further miniaturized. In a case where the antenna member of the present invention is made from a sheet metal plate, a blank can be cut out from the sheet metal plate without any waste. Accordingly, the present invention is more effective in this case.

An appreciation of the objectives of the present invention and a more complete understanding of its structure may be had by studying the following description of the preferred embodiment and by referring to the accompanying drawings.

Figure 1:
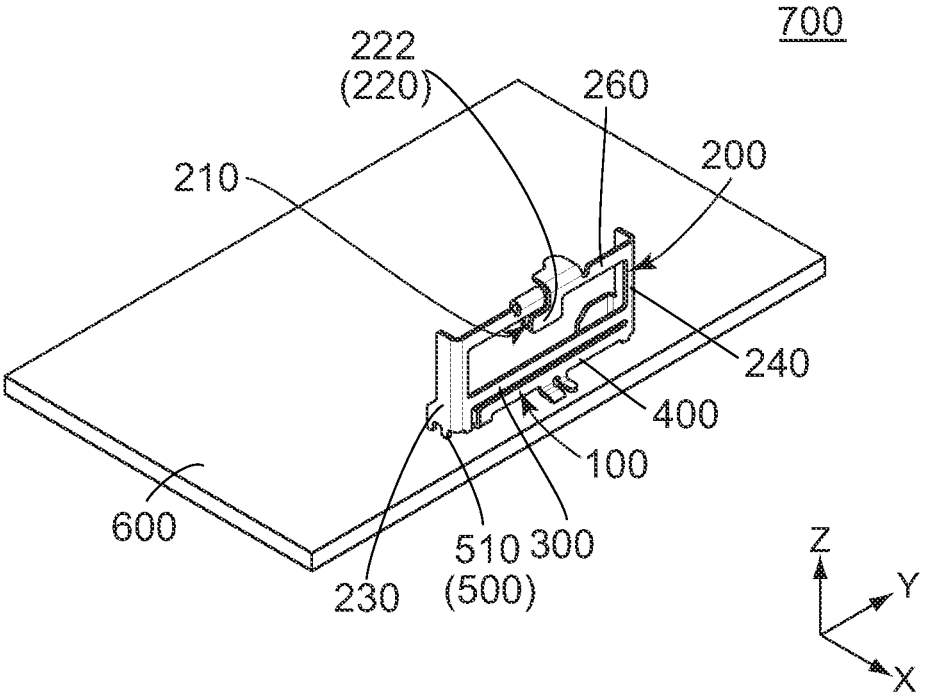
FIG. 1 is a front, perspective view showing an assembly according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

First Embodiment

As shown in FIG. 1, an assembly 700 according to a first embodiment of the present invention comprises a circuit board 600 and an antenna member 100 which is mounted on the circuit board 600. The circuit board 600 has a feed pattern (not shown) and a ground pattern (not shown).

As shown in FIG. 1, the antenna member 100 of the present embodiment is configured to be mounted on the circuit board 600 and to be used as an antenna. The antenna member 100 is made of metal. More specifically, the antenna member 100 is formed by punching out a blank from a single sheet metal plate, followed by bending the blank.

Figure 8:
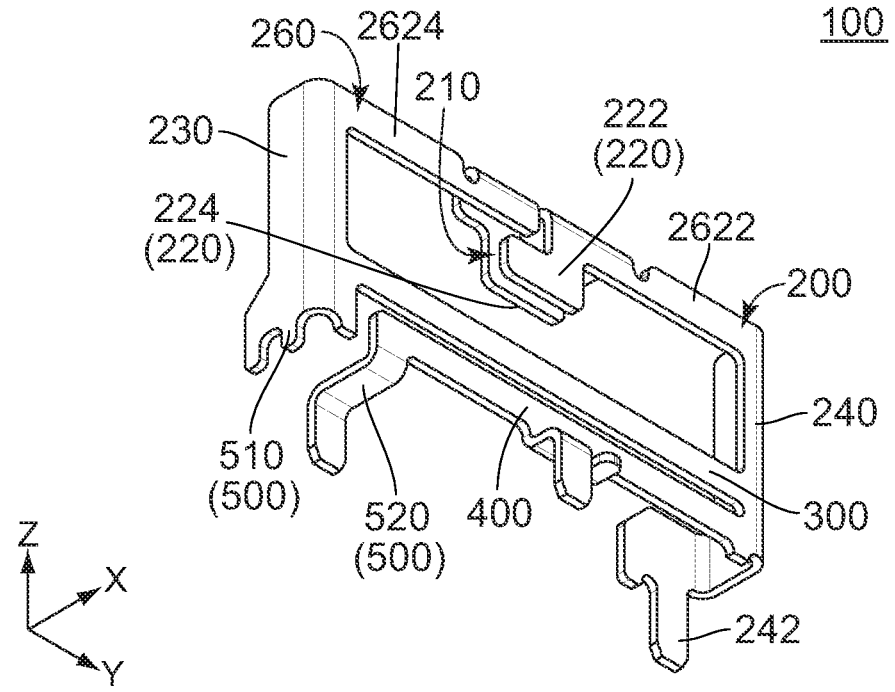
FIG. 8 is a lower, perspective view showing the antenna member of FIG. 7.

As shown in FIG. 8, the antenna member 100 of the present embodiment has a split ring resonating portion 200, an impedance matching portion 300 and a feed portion 500.

Figure 9:
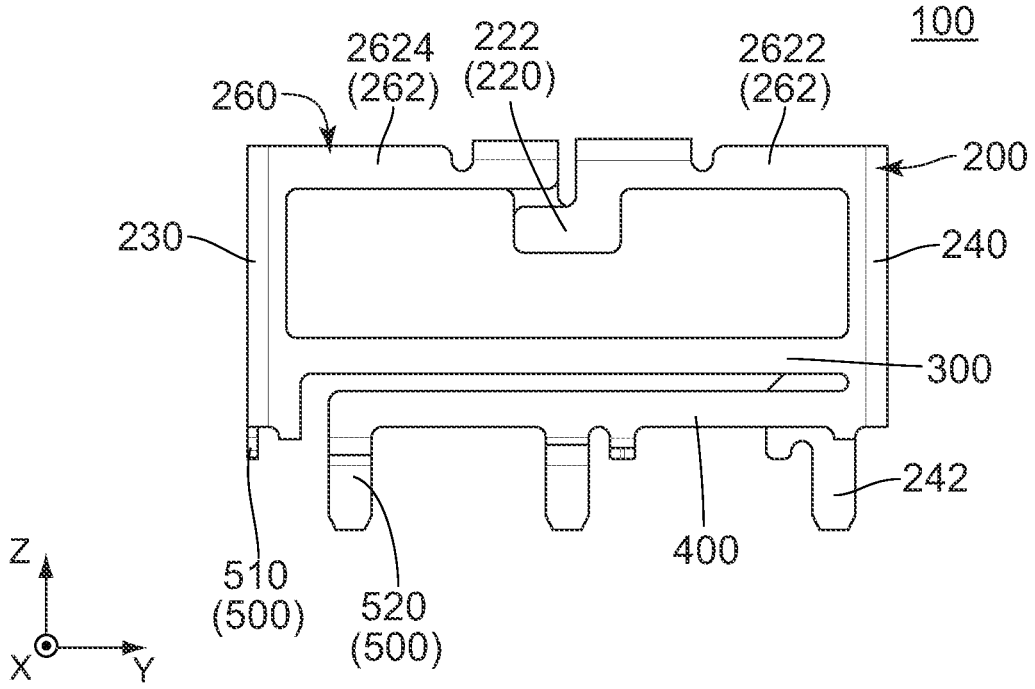
FIG. 9 is a front view showing the antenna member of FIG. 7.
Figure 10:
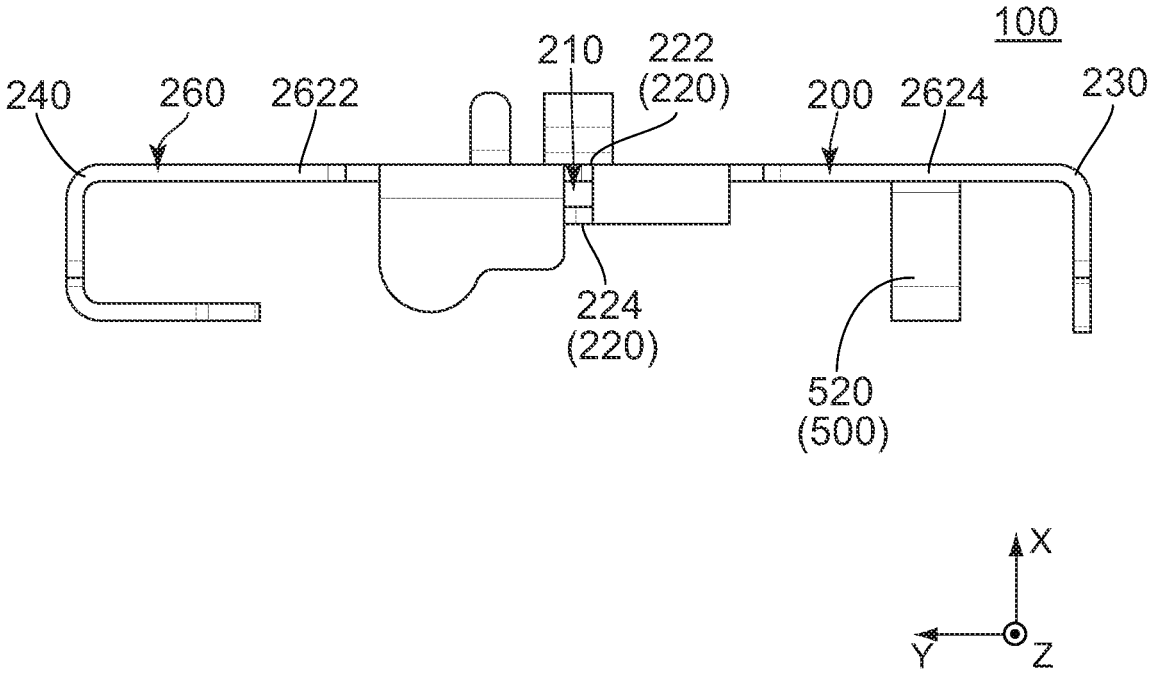
FIG. 10 is a top view showing the antenna member of FIG. 7.
Figure 11:
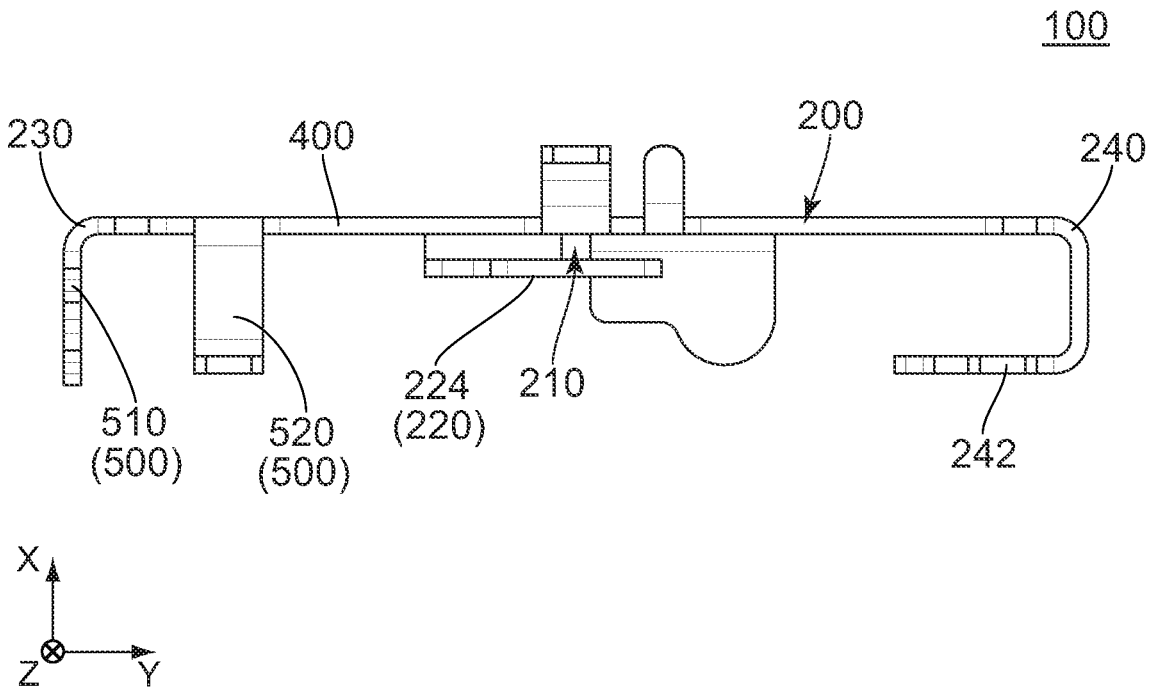
FIG. 11 is a bottom view showing the antenna member of FIG. 7.
Figure 12:
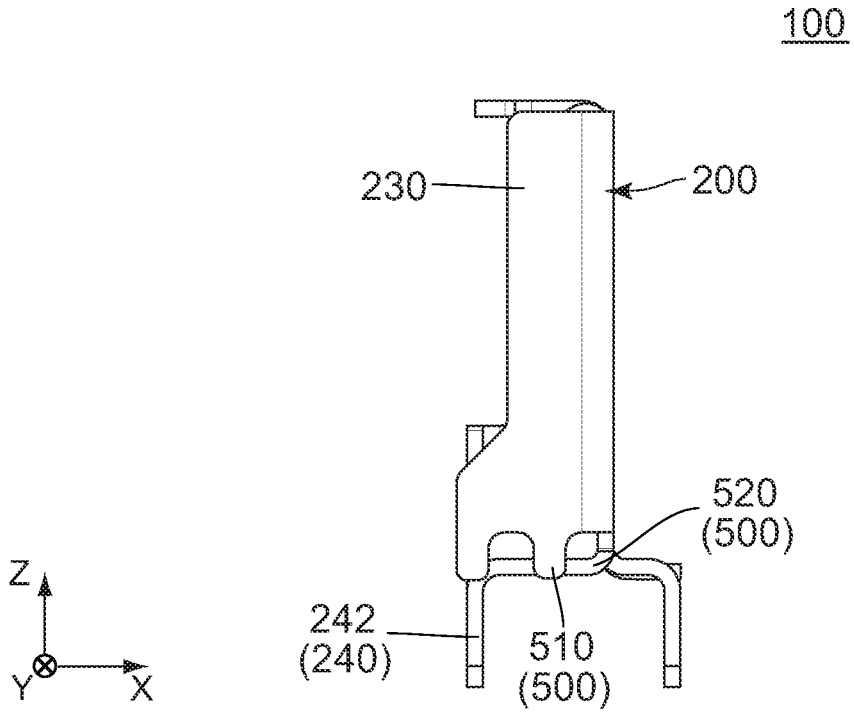
FIG. 12 is a side view showing the antenna member of FIG. 7.

As shown in FIG. 9, the split ring resonating portion 200 of the present embodiment has a substantially rectangular shape in a plane perpendicular to a front-rear direction. In the present embodiment, the front-rear direction is an X-direction. Specifically, it is assumed that forward is a positive X-direction while rearward is a negative X-direction. The split ring resonating portion 200 has a first side portion 230, a second side portion 240, an upper portion 260 and a lower portion 400.

As shown in FIG. 9, the first side portion 230 of the present embodiment extends in an up-down direction. In the present embodiment, the up-down direction is a Z-direction. Specifically, it is assumed that upward is a positive Z-direction while downward is a negative Z-direction. The first side portion 230 defines a left end of the split ring resonating portion 200 in a lateral direction. In the present embodiment, the lateral direction is a Y-direction. Specifically, rightward is a positive Y-direction while leftward is a negative Y-direction. In the lateral direction, the first side portion 230 is positioned away from and leftward beyond the second side portion 240.

As shown in FIG. 9, the second side portion 240 of the present embodiment extends in the up-down direction. The second side portion 240 defines a right end of the split ring resonating portion 200 in the lateral direction. The second side portion 240 is positioned away from the first side portion 230 in the lateral direction. Specifically, in the lateral direction, the second side portion 240 is positioned away from and rightward beyond the first side portion 230. As shown in FIG. 8, the second side portion 240 has a fixed portion 242.

Figure 2:
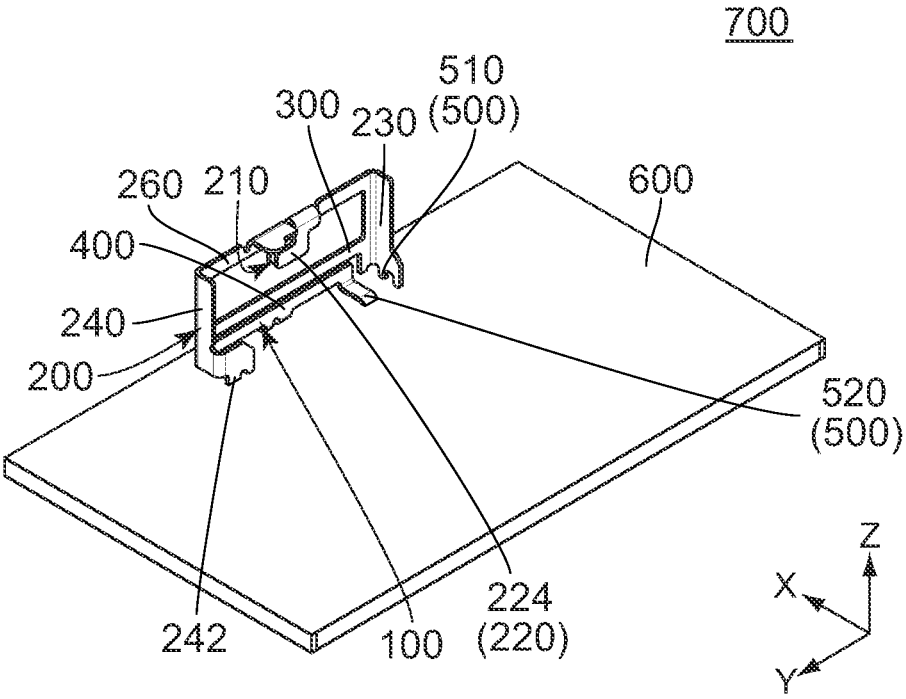
FIG. 2 is a rear, perspective view showing the assembly of FIG. 1.
Figure 3:
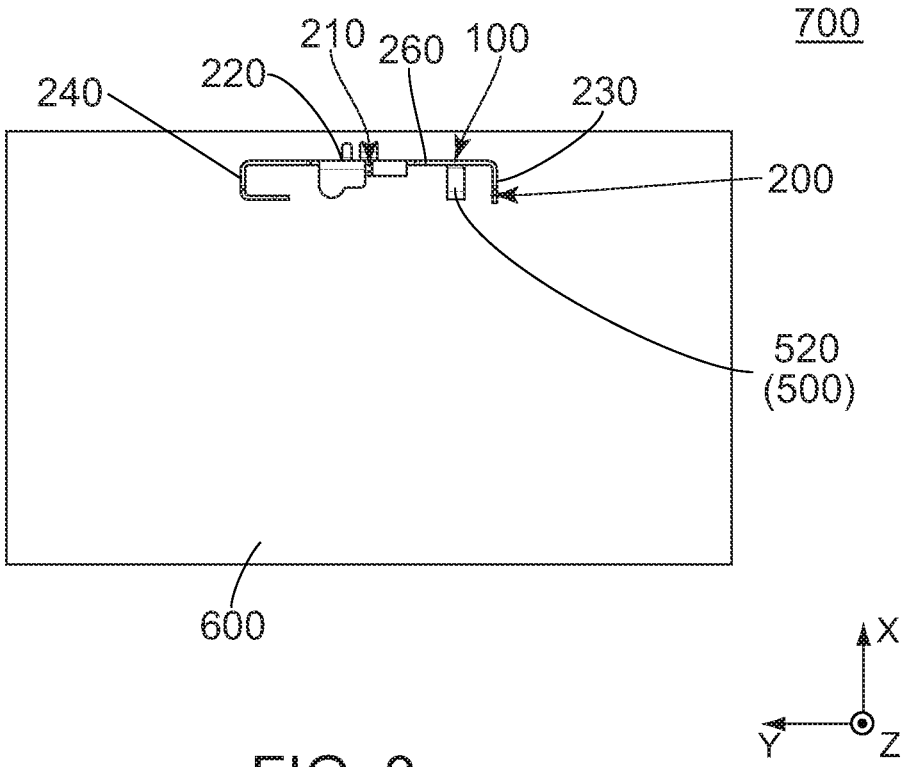
FIG. 3 is a top view showing the assembly of FIG. 1.
Figure 4:
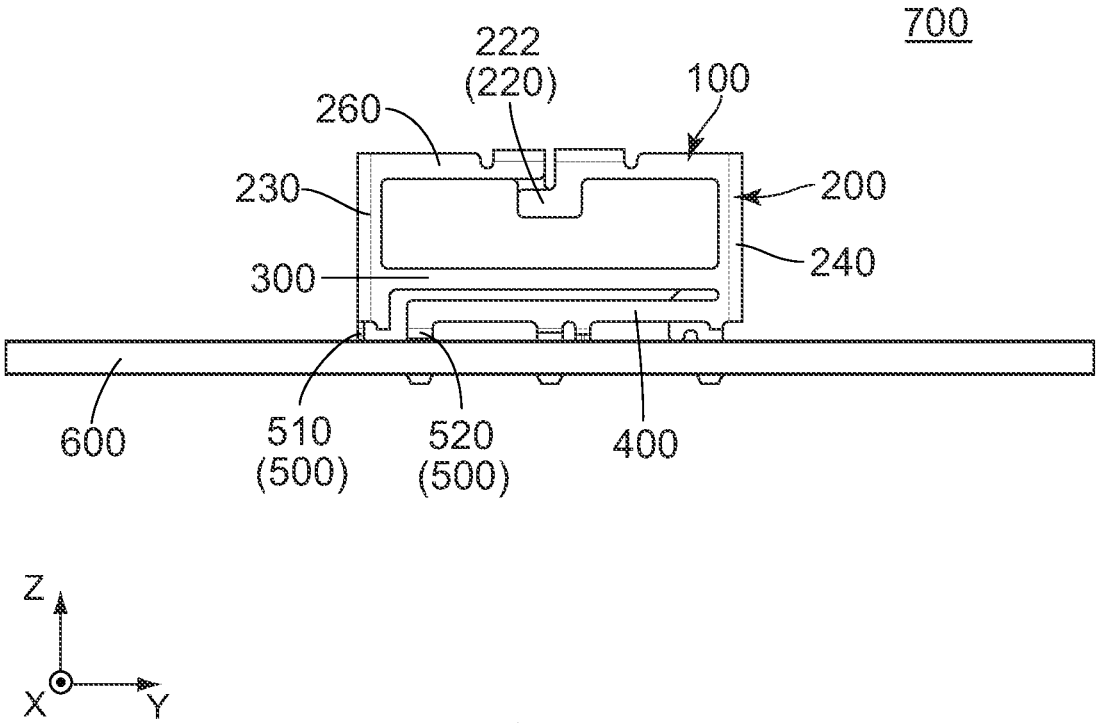
FIG. 4 is a front view showing the assembly of FIG. 1.
Figure 5:
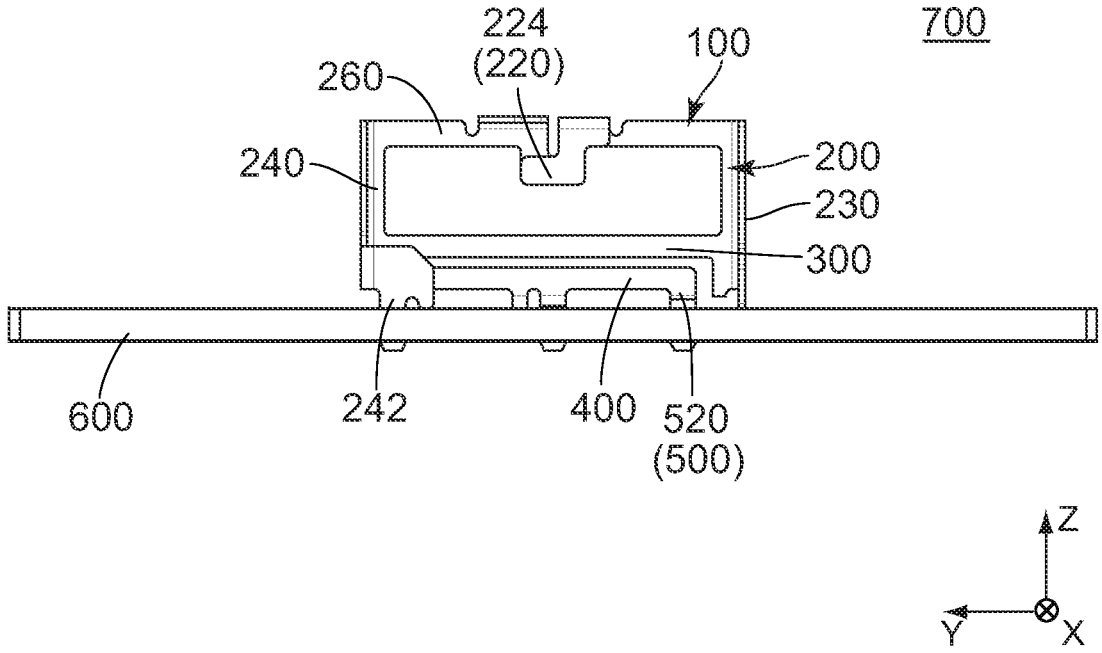
FIG. 5 is a rear view showing the assembly of FIG. 1.
Figure 6:
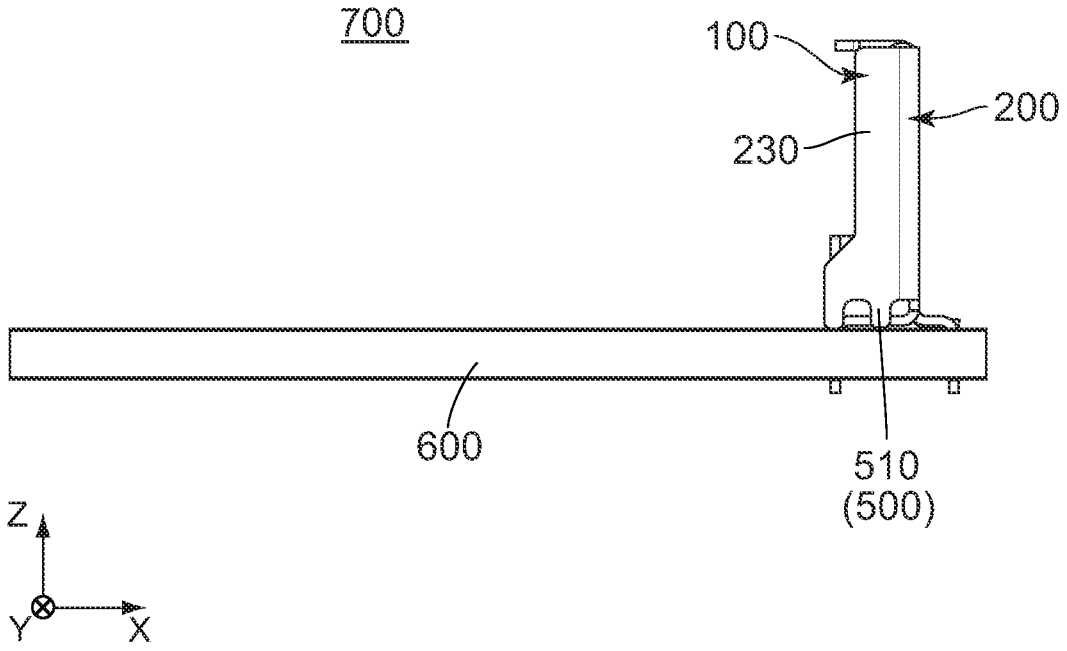
FIG. 6 is a side view showing the assembly of FIG. 1.
Figure 7:
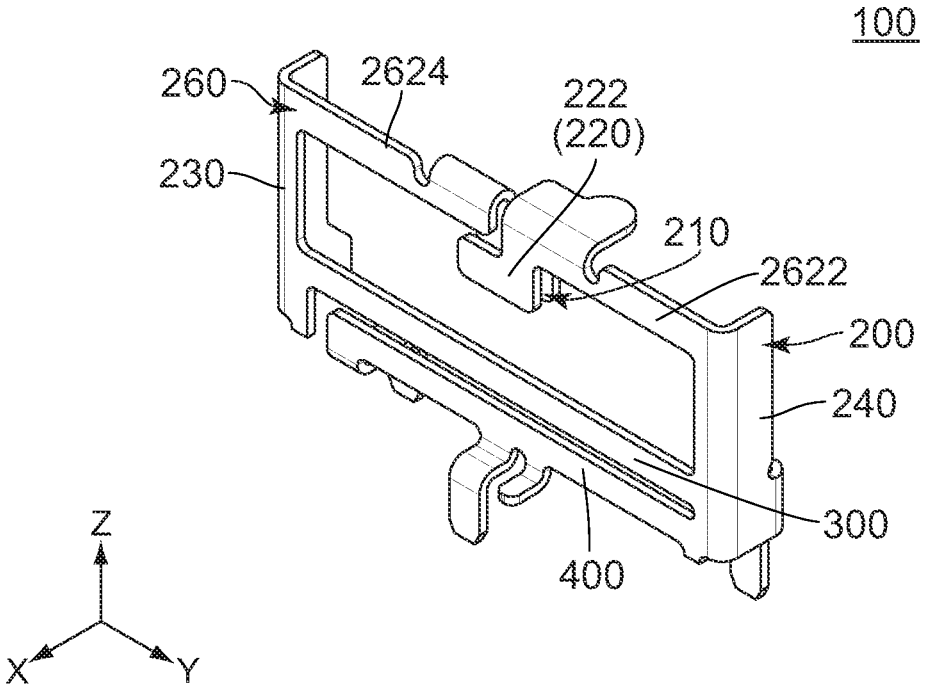
FIG. 7 is an upper, perspective view showing an antenna member which is included in the assembly of FIG. 1.

Referring to FIGS. 2 and 8, the fixed portion 242 of the present embodiment is fixed to the circuit board 600 when the antenna member 100 is mounted on the circuit board 600. The fixed portion 242 defines a lower end of the antenna member 100 in the up-down direction. The fixed portion 242 extends downward from a lower end of the second side portion 240.

As shown in FIG. 9, the upper portion 260 of the present embodiment defines an upper end of the split ring resonating portion 200 in the up-down direction. The upper portion 260 extends in the lateral direction. The upper portion 260 connects the first side portion 230 and the second side portion 240 with each other. More specifically, the upper portion 260 connects an upper end of the first side portion 230 and an upper end of the second side portion 240 with each other. The upper portion 260 electromagnetically connects the first side portion 230 and the second side portion 240 with each other. The upper portion 260 has a facing portion 220 and an upper frame portion 262.

As shown in FIG. 8, the facing portion 220 of the present embodiment forms a split 210. Specifically, the split ring resonating portion 200 is provided with the facing portion 220 which forms the split 210. The facing portion 220 forms a capacitance of the antenna member 100. The facing portion 220 has a front facing portion 222 and a rear facing portion 224. The front facing portion 222 and the rear facing portion 224 face each other in the front-rear direction with a space left therebetween. The front facing portion 222 is positioned forward beyond the rear facing portion 224 in the front-rear direction. The split 210 is positioned between the front facing portion 222 and the rear facing portion 224 in the front-rear direction.

As shown in FIG. 9, the upper frame portion 262 of the present embodiment has a right portion 2622 and a left portion 2624. The right portion 2622 extends rightward in the lateral direction from the front facing portion 222. The right portion 2622 couples the front facing portion 222 and the second side portion 240 with each other. As shown in FIG. 8, the left portion 2624 extends leftward in the lateral direction from the rear facing portion 224. The left portion 2624 couples the rear facing portion 224 and the first side portion 230 with each other.

As shown in FIG. 8, the lower portion 400 of the present embodiment extends from the second side portion 240 toward the first side portion 230. The lower portion 400 is positioned between the first side portion 230 and the second side portion 240 in the lateral direction. The lower portion 400 is not coupled with the first side portion 230. The lower portion 400 is positioned away from the impedance matching portion 300 in the up-down direction. The lower portion 400 is positioned below the impedance matching portion 300 in the up-down direction.

Referring to FIG. 9, a frame body, which is formed by the first side portion 230, the second side portion 240, the upper frame portion 262 and lower portion 400, forms an inductance of the antenna member 100.

As shown in FIG. 8, the feed portion 500 of the present embodiment consists of a first feed portion 510 and a second feed portion 520.

As shown in FIG. 9, the first feed portion 510 of the present embodiment is provided on a lower end of the first side portion 230 in the up-down direction. Referring to FIGS. 2 and 8, when the antenna member 100 is mounted on the circuit board 600, high-frequency AC power is supplied to the first feed portion 510 from a high-frequency source (not shown) via the feed pattern of the circuit board 600 as shown in FIG. 2.

Referring to FIGS. 2 and 8, the second feed portion 520 of the present embodiment is provided on an end portion of the lower portion 400. More specifically, the second feed portion 520 is provided on a left end portion of the lower portion 400. The lower portion 400 is positioned above the second feed portion 520 in the up-down direction. The second feed portion 520 is connected with the ground pattern of the circuit board 600 when the antenna member 100 is mounted on the circuit board 600. Specifically, when the antenna member 100 is mounted on the circuit board 600, the lower portion 400 is connected with a ground of the circuit board 600 only at the second feed portion 520. However, the present invention is not limited thereto. Specifically, the whole of a lower end of the lower portion 400 may be brought into contact with the ground of the circuit board 600 when the antenna member 100 is mounted on the circuit board 600.

As described above, the facing portion 220 forms the capacitance of the antenna member 100, and the frame body, which is formed by the first side portion 230, the second side portion 240, the upper frame portion 262 and the lower portion 400, forms the inductance of the antenna member 100. Accordingly, the facing portion 220 and the frame body constitute an LC resonant circuit. In other words, the antenna member 100 has a split ring resonator which is formed by the first side portion 230, the second side portion 240, the upper portion 260 and the lower portion 400.

As shown in FIG. 9, the impedance matching portion 300 of the present embodiment extends in the lateral direction. More specifically, the impedance matching portion 300 extends linearly in the lateral direction. The impedance matching portion 300 intersects with the up-down direction. More specifically, the impedance matching portion 300 is perpendicular to the up-down direction. The impedance matching portion 300 is positioned below the upper portion 260 in the up-down direction. The impedance matching portion 300 is positioned below the facing portion 220 in the up-down direction. The impedance matching portion 300 is positioned above the feed portion 500 in the up-down direction perpendicular to the lateral direction. The impedance matching portion 300 couples the first side portion 230 and the second side portion 240 with each other. The impedance matching portion 300 adjusts an impedance of the antenna member 100 by a distance from the impedance matching portion 300 to the lower portion 400 and/or by a length of a portion of the impedance matching portion 300 which faces the lower portion 400. In other words, the impedance of the antenna member 100 of the present embodiment can be adjusted only by a relationship between the impedance matching portion 300 and the lower portion 400 which are components of the antenna member 100. Thus, the adjusted impedance of the antenna member 100 has reduced variation as compared to an adjusted impedance of an antenna member whose impedance is influenced by the ground of the circuit board 600.

Since the antenna member 100 of the present embodiment has the impedance matching portion 300, the antenna member 100 can exhibit improved return loss characteristics as compared to an assumption where the antenna member 100 have no impedance matching portion 300.

Second Embodiment

Figure 13:
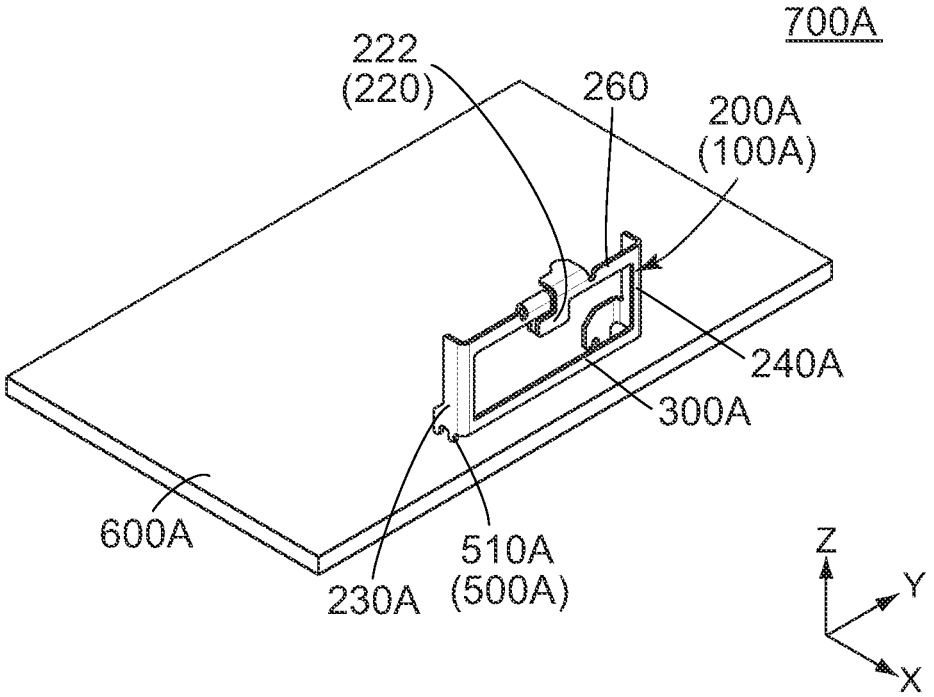
FIG. 13 is a front, perspective view showing an assembly according to a second embodiment of the present invention.

As shown in FIG. 13, an assembly 700A according to a second embodiment of the present invention comprises a circuit board 600A and an antenna member 100A which is mounted on the circuit board 600A. The antenna member 100A of the present embodiment is configured to be mounted on the circuit board 600A and to be used as an antenna. The circuit board 600A has a feed pattern (not shown) and a ground pattern (not shown).

Figure 20:
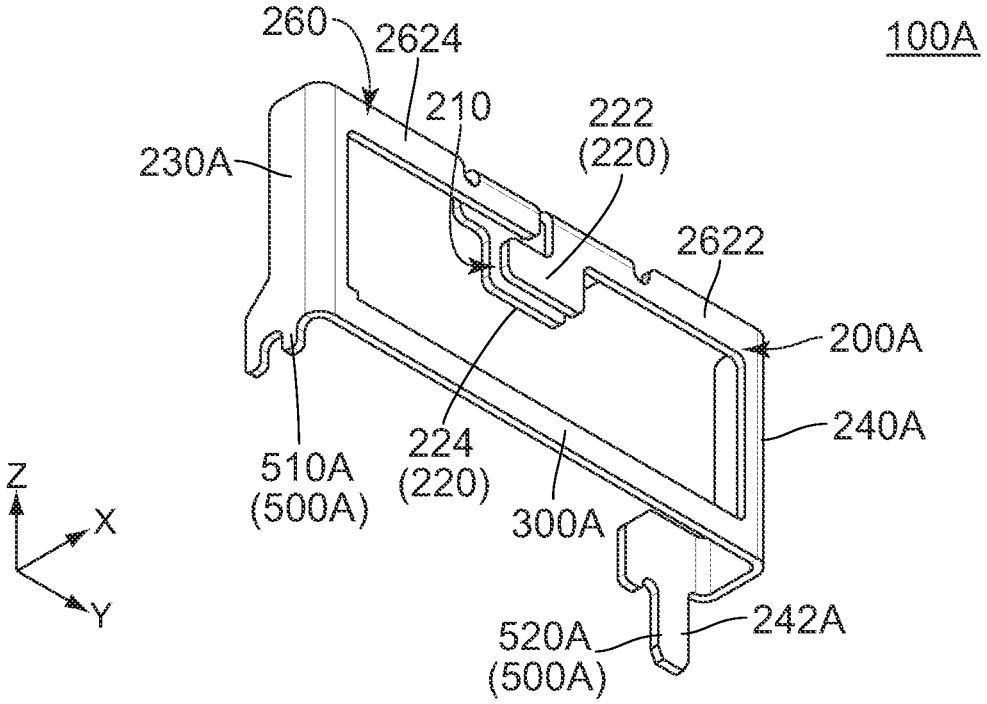
FIG. 20 is a lower, perspective view showing the antenna member of FIG. 19.

As shown in FIG. 20, the antenna member 100A according the second embodiment of the present invention has a structure similar to that of the antenna member 100 (see FIG. 8) of the aforementioned first embodiment except that the antenna member 100A has no lower portion 400. Accordingly, components similar to those of the first embodiment among components shown in FIGS. 13 to 24 will be designated by the same reference numerals as those of the first embodiment. As for directions and orientations in the present embodiment, expressions same as those of the first embodiment will be used hereinbelow.

As shown in FIG. 20, the antenna member 100A of the present embodiment has a split ring resonating portion 200A, an impedance matching portion 300A and a feed portion 500A.

Figure 21:
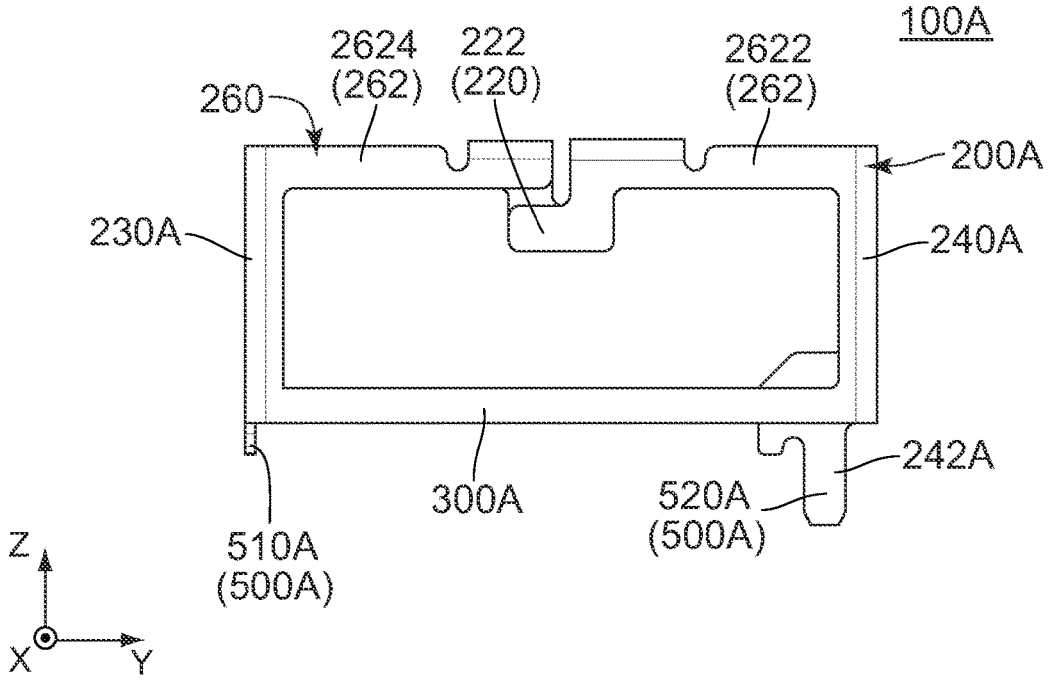
FIG. 21 is a front view showing the antenna member of FIG. 19.
Figure 22:
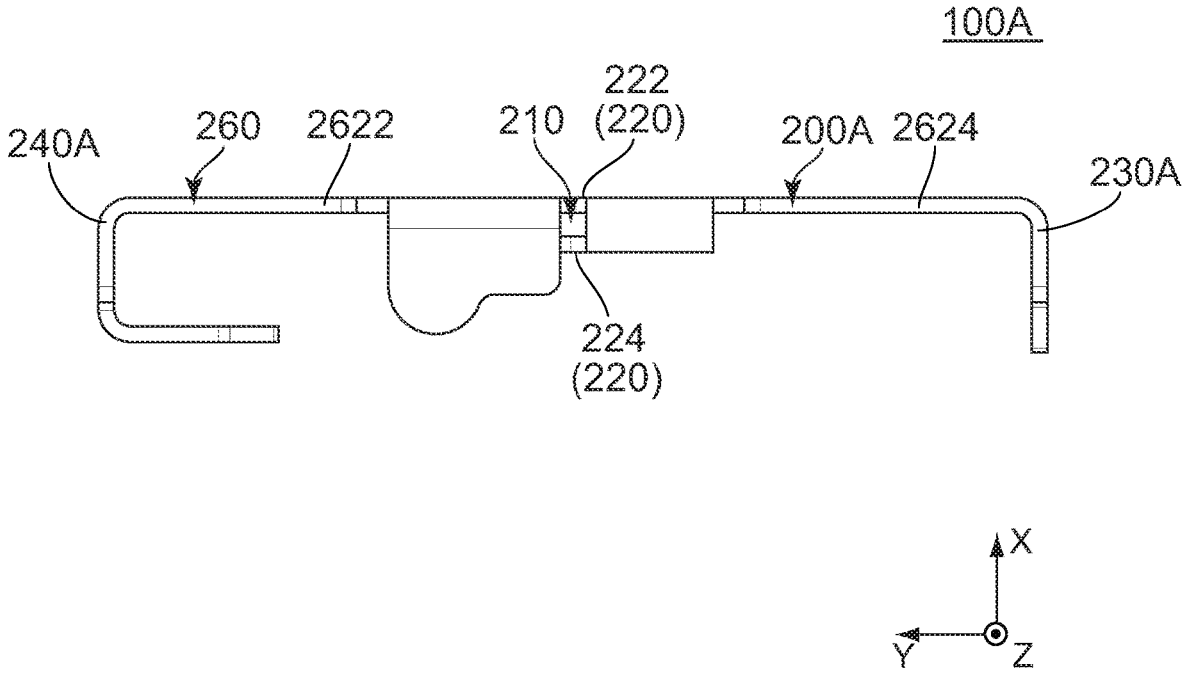
FIG. 22 is a top view showing the antenna member of FIG. 19.
Figure 23:
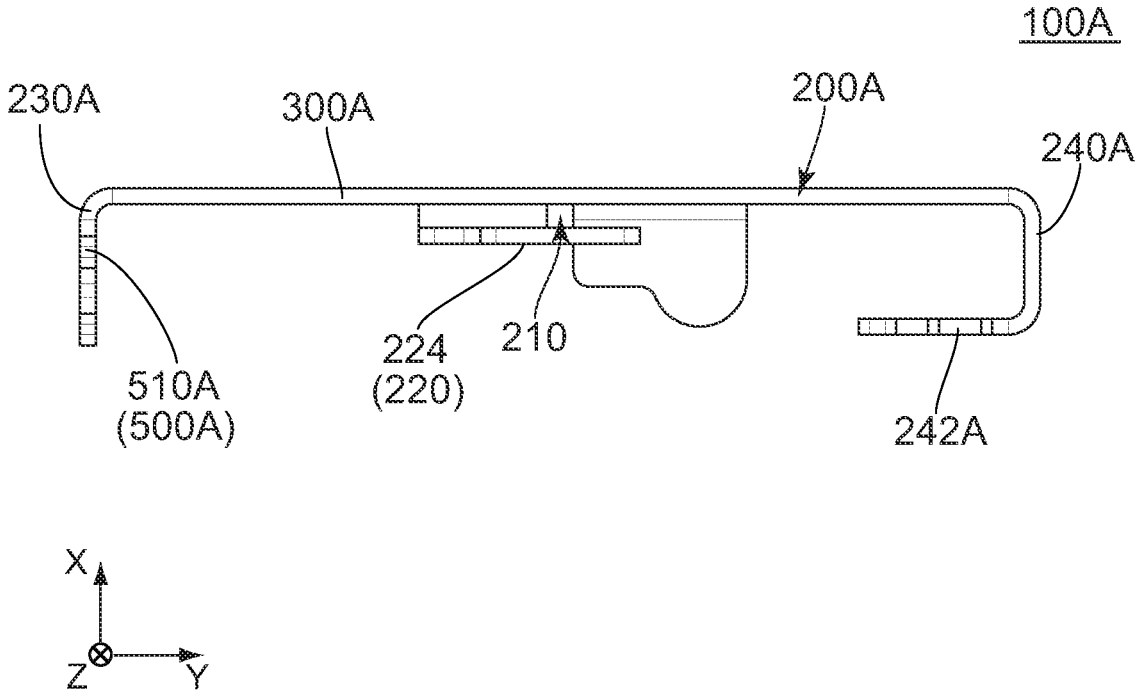
FIG. 23 is a bottom view showing the antenna member of FIG. 19.
Figure 24:
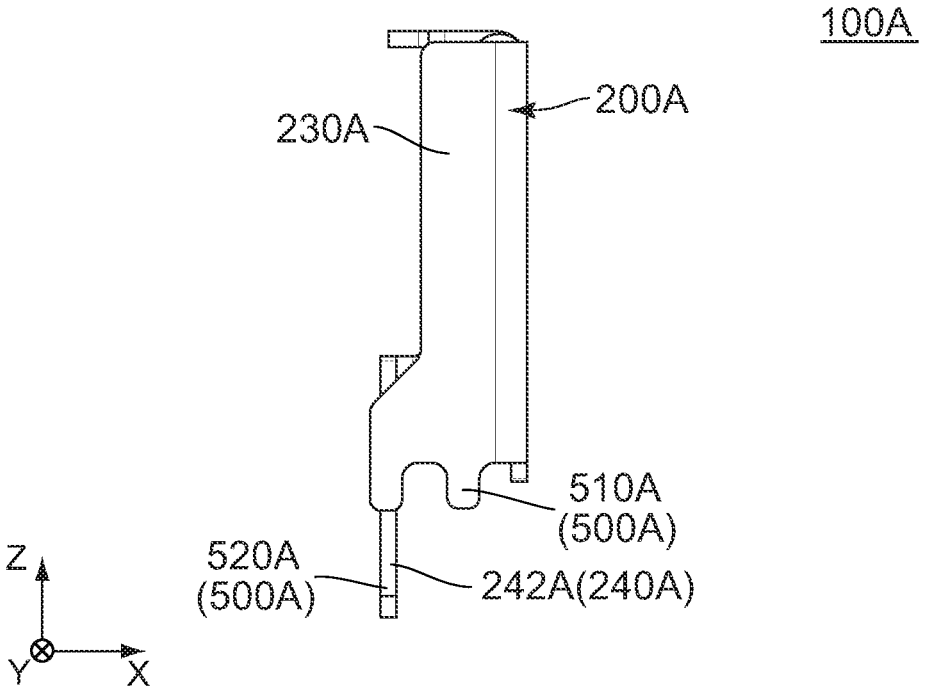
FIG. 24 is a side view showing the antenna member of FIG. 19.
Figure 25:
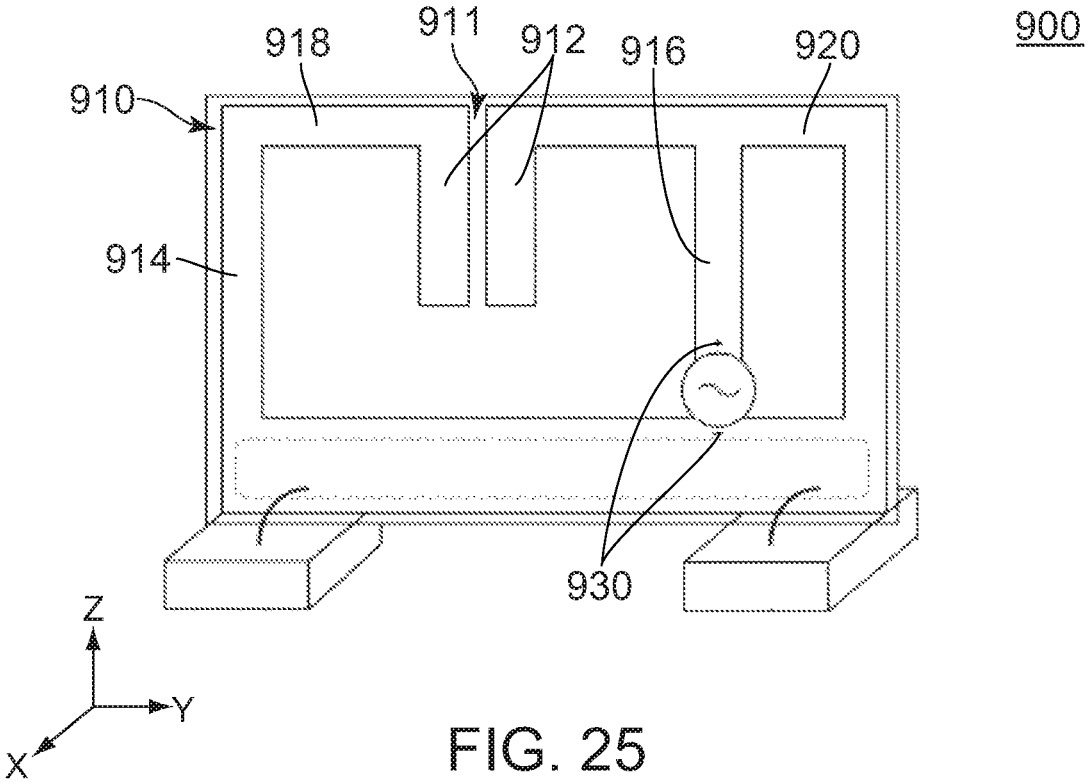
FIG. 25 PRIOR ART
FIG. 25 is a front view showing an antenna member of Patent Document 1.

As shown in FIG. 21, the split ring resonating portion 200A of the present embodiment has a substantially rectangular shape in a plane perpendicular to the front-rear direction. The split ring resonating portion 200A has a first side portion 230A, a second side portion 240A and an upper portion 260. As shown in FIG. 20, the split ring resonating portion 200A is provided with a facing portion 220 which forms a split 210. The facing portion 220 forms a capacitance of the antenna member 100A. The upper portion 260, the split 210 and the facing portion 220 of the present embodiment have structures same as those of the upper portion 260, the split 210 and the facing portion 220 of the first embodiment. Accordingly, a detailed explanation thereabout is omitted.

As shown in FIG. 21, the first side portion 230A of the present embodiment extends in the up-down direction. The first side portion 230A defines a left end of the split ring resonating portion 200A in the lateral direction. In the lateral direction, the first side portion 230A is positioned away from and leftward beyond the second side portion 240A.

As shown in FIG. 21, the second side portion 240A of the present embodiment extends in the up-down direction. The second side portion 240A defines a right end of the split ring resonating portion 200A in the lateral direction. The second side portion 240A is positioned away from the first side portion 230A in the lateral direction. Specifically, in the lateral direction, the second side portion 240A is positioned away from and rightward beyond the first side portion 230A. As shown in FIG. 20, the second side portion 240A has a fixed portion 242A.

Figure 14:
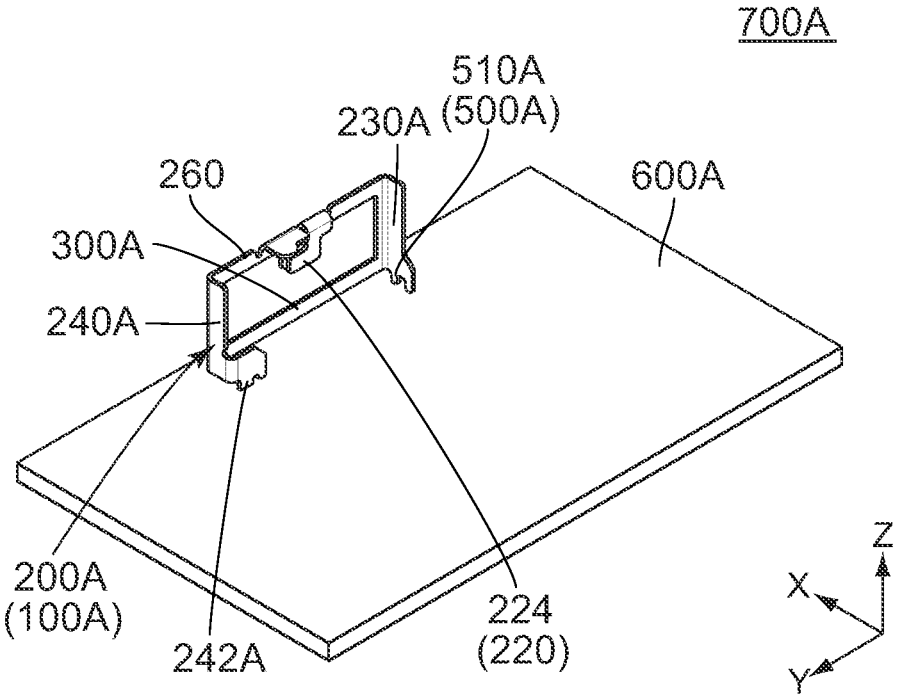
FIG. 14 is a rear, perspective view showing the assembly of FIG. 13.
Figure 15:
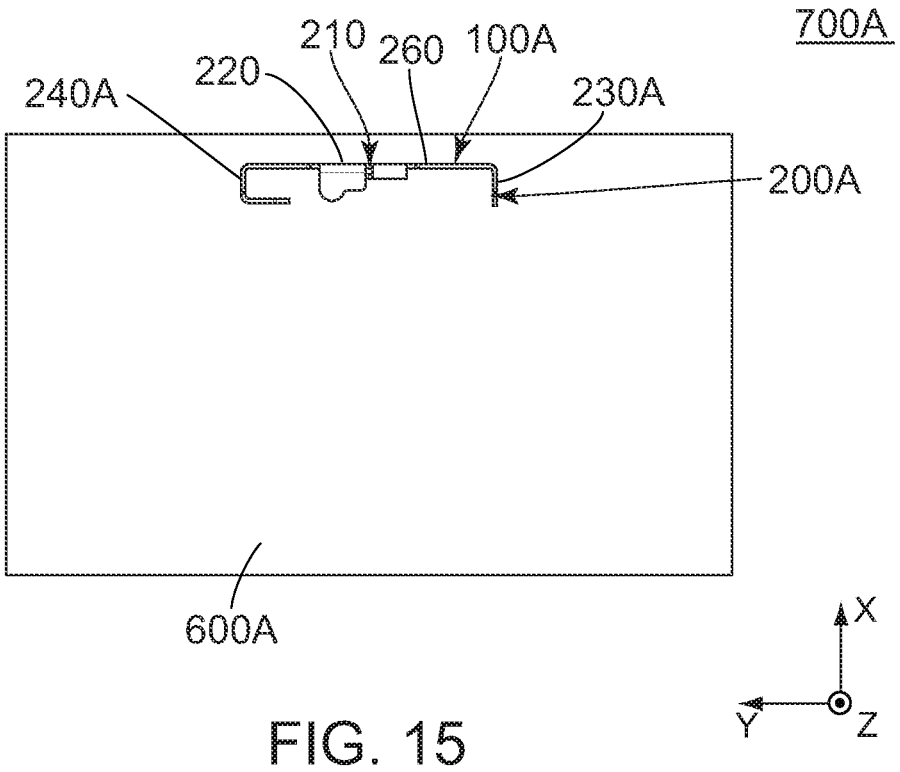
FIG. 15 is a top view showing the assembly of FIG. 13.
Figure 16:
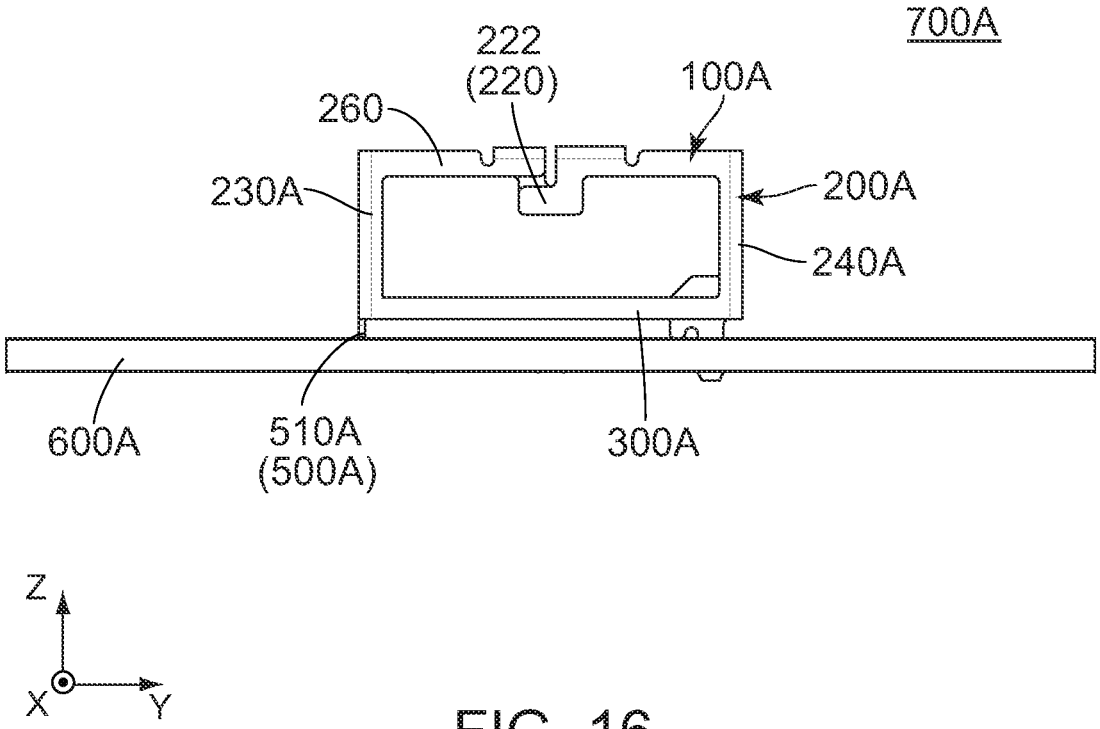
FIG. 16 is a front view showing the assembly of FIG. 13.
Figure 17:
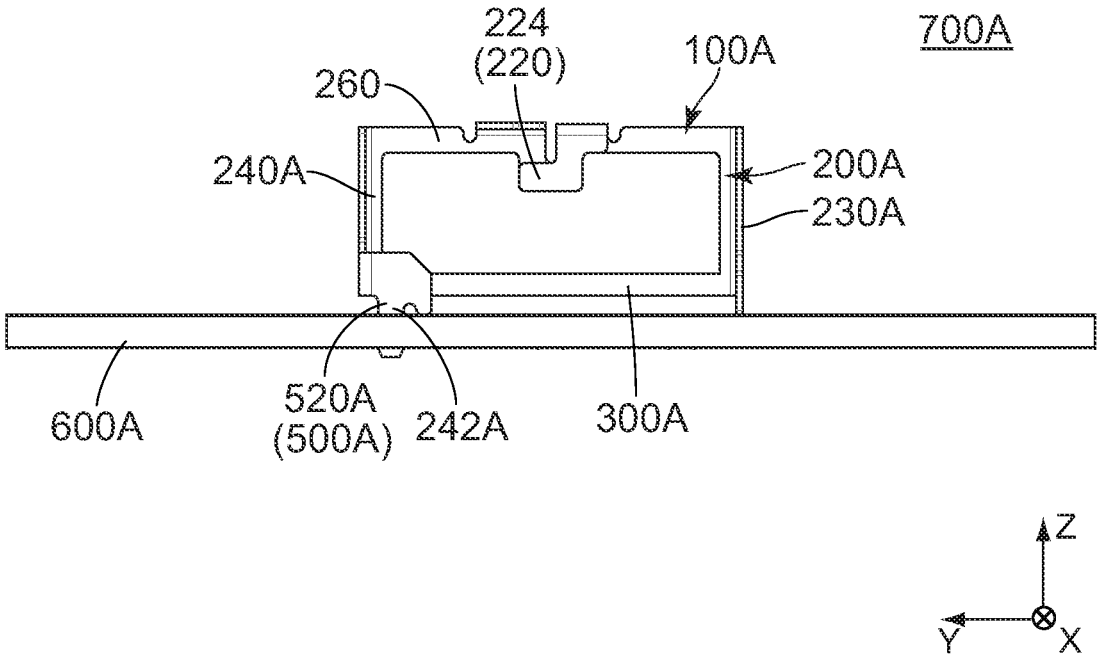
FIG. 17 is a rear view showing the assembly of FIG. 13.
Figure 18:
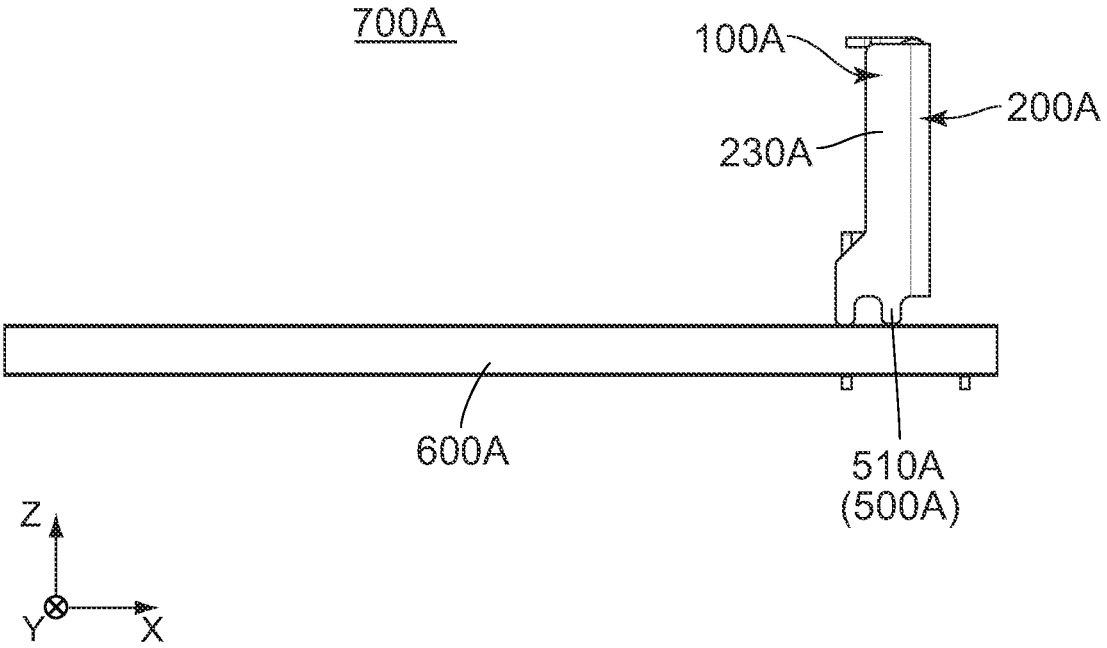
FIG. 18 is a side view showing the assembly of FIG. 13.
Figure 19:
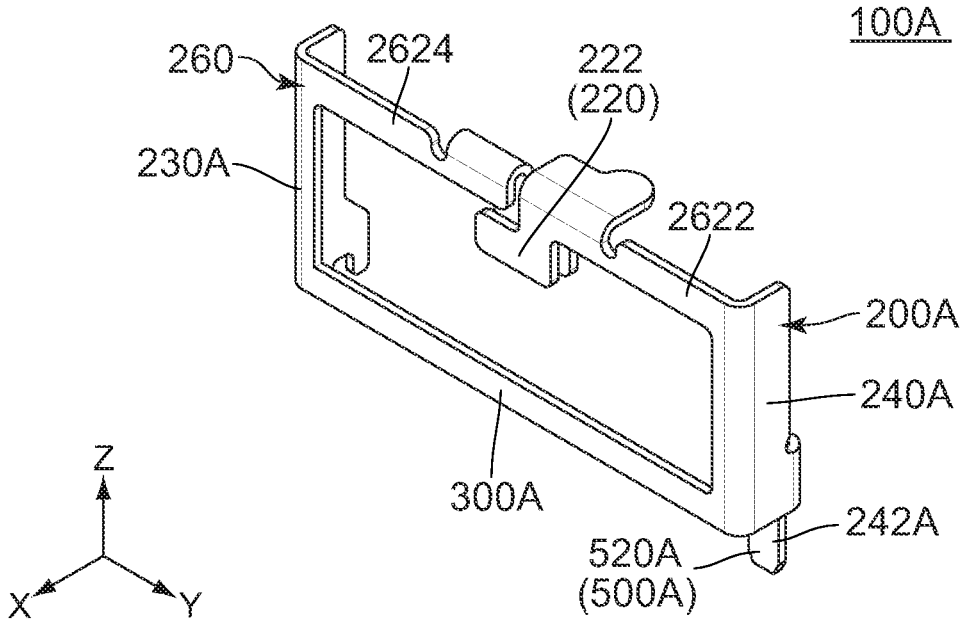
FIG. 19 is an upper, perspective view showing an antenna member which is included in the assembly of FIG. 13.

Referring to FIGS. 14 and 20, the fixed portion 242A of the present embodiment is fixed to the circuit board 600A when the antenna member 100A is mounted on the circuit board 600A. The fixed portion 242A defines a lower end of the antenna member 100A in the up-down direction. The fixed portion 242A extends downward from a lower end of the second side portion 240A.

As shown in FIG. 20, the feed portion 500A of the present embodiment consists of a first feed portion 510A and a second feed portion 520A.

As shown in FIG. 20, the first feed portion 510A of the present embodiment is provided on a lower end of the first side portion 230A in the up-down direction. Referring to FIGS. 14 and 20, when the antenna member 100A is mounted on the circuit board 600A, high-frequency AC power is supplied to the first feed portion 510A from a high-frequency source (not shown) via the feed pattern of the circuit board 600A.

As shown in FIG. 20, the second feed portion 520A of the present embodiment is positioned at a lower end of the fixed portion 242A. Referring to FIGS. 14 and 20, the second feed portion 520A is connected with the ground pattern of the circuit board 600A when the antenna member 100A is mounted on the circuit board 600A.

As shown in FIG. 21, the impedance matching portion 300A of the present embodiment extends in the lateral direction. More specifically, the impedance matching portion 300A extends linearly in the lateral direction. The impedance matching portion 300A intersects with the up-down direction. More specifically, the impedance matching portion 300A is perpendicular to the up-down direction. The impedance matching portion 300A is positioned below the upper portion 260 in the up-down direction. The impedance matching portion 300A is positioned below the facing portion 220 in the up-down direction. The impedance matching portion 300A is positioned above the feed portion 500A in the up-down direction perpendicular to the lateral direction. The impedance matching portion 300A couples the first side portion 230A and the second side portion 240A with each other. The impedance matching portion 300A adjusts an impedance of the antenna member 100A by a distance from the impedance matching portion 300A to a ground of the circuit board 600A and/or by a length of a portion of the impedance matching portion 300A which faces the ground of the circuit board 600A.

Since the antenna member 100A of the present embodiment has the impedance matching portion 300A, the antenna member 100A can exhibit improved return loss characteristics as compared to an assumption where the antenna member 100A have no impedance matching portion 300A.

Referring to FIG. 21, a member, which is formed by the first side portion 230A, the second side portion 240A and an upper frame portion 262, forms an inductance of the antenna member 100A. As described above, the facing portion 220 forms the capacitance of the antenna member 100A. Accordingly, the aforementioned member and the facing portion 220 constitute an LC resonant circuit. Referring to FIG. 13, the assembly 700A has a split ring resonator which is formed by the first side portion 230A, the second side portion 240A, the upper portion 260 and the ground of the circuit board 600A.

Although the specific explanation about the present invention is made above referring to the embodiments, the present invention is not limited thereto and is susceptible to various modifications and alternative forms.

Although each of the antenna members 100, 100A of the aforementioned embodiments is configured so that the facing portion 220 is provided on the upper portion 260, the present invention is not limited thereto. Specifically, the antenna member 100 may be modified so that the facing portion 220 is provided on the first side portion 230 or on the second side portion 240. Similarly, the antenna member 100A may be modified so that the facing portion 220 is provided on the first side portion 230A or on the second side portion 240A. However, considering a possibility of using its secondary resonance, it is desirable that the facing portion 220 is provided on the upper portion 260.

Although each of the split ring resonating portion 200, 200A of the aforementioned embodiments has the substantially rectangular shape in the plane perpendicular to the front-rear direction, the present invention is not limited thereto. Specifically, the split ring resonating portion 200 may have an arc shape, a polygonal shape or a shape which is a part of a polygonal shape. Similarly, the split ring resonating portion 200A may have an arc shape, a polygonal shape or a shape which is a part of a polygonal shape. However, from a point of view of strength of the split-ring resonating portion 200, 200A, the split-ring resonating portion 200, 200A is preferred to have a rectangular shape or the substantially rectangular shape.

Although the impedance matching portion 300 of the aforementioned first embodiment extends linearly in the lateral direction, the present invention is not limited thereto. Specifically, the impedance matching portion 300 may be modified to be bulged forward or rearward. The aforementioned modification of the impedance matching portion 300 enables a reduction of a capacitance between the modified impedance matching portion 300 and the lower portion 400. However, if the impedance matching portion 300 is too close to the facing portion 220, antenna characteristics of the antenna member 100 is degraded. Accordingly, it is preferred that the impedance matching portion 300 is bulged forward or rearward while the impedance matching portion 300 is positioned away from the facing portion 220. Additionally, from a point of view of strength of the impedance matching portion 300, it is preferable that the impedance matching portion 300 extends linearly in the lateral direction similar to the present embodiment.

Although the feed portion 500 of the aforementioned first embodiment is provided on both of the lower end of the first side portion 230 and the end portion of the lower portion 400, the present embodiment is not limited thereto. Specifically, the feed portion 500 should be provided on at least one of the first side portion 230 and the second side portion 240.

Although the feed portion 500A of the aforementioned second embodiment is provided on both of the lower ends of the first side portion 230A and the fixed portion 242A, the present embodiment is not limited thereto. Specifically, the feed portion 500A should be provided on at least one of the first side portion 230A and the second side portion 240A.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna member which is configured to be mounted on a circuit board and to be used as an antenna, wherein:

the antenna member has a split ring resonating portion, an impedance matching portion and a feed portion;

the split ring resonating portion is provided with a facing portion which forms a split;

the split ring resonating portion has a first side portion, a second side portion and an upper portion;

the second side portion is positioned away from the first side portion in a lateral direction;

the upper portion connects the first side portion and the second side portion with each other;

the feed portion is provided on at least one of the first side portion and the second side portion;

the impedance matching portion is made of metal;

the impedance matching portion is positioned above the feed portion in an up-down direction perpendicular to the lateral direction;

the impedance matching portion couples the first side portion and the second side portion with each other; and the impedance matching portion is positioned below the facing portion in the up-down direction.

2. The antenna member as recited in claim 1, wherein:

the split ring resonating portion further has a lower portion;

the lower portion extends from the second side portion toward the first side portion; and in the up-down direction, the lower portion is positioned away from the impedance matching portion and below the impedance matching portion.

3. The antenna member as recited in claim 2, wherein:

the feed portion consists of a first feed portion and a second feed portion;

the first side portion has a lower end in the up-down direction;

the first feed portion is provided on the lower end of the first side portion;

the lower portion has an end portion; and the second feed portion is provided on the end portion of the lower portion.

4. An assembly comprising the antenna member as recited in claim 1 and the circuit board, wherein the antenna member is mounted on the circuit board.

* * * * *